US006094937A

United States Patent [19]

Paurola et al.

[11] Patent Number: 6,094,937

[45] Date of Patent: Aug. 1, 2000

[54] PROCESS, PLANT AND OVERALL SYSTEM FOR HANDLING AND TREATING A HYDROCARBON GAS FROM A PETROLEUM DEPOSIT

[75] Inventors: Pentti Paurola, Hafrsfjord; Sigbjørn Lillesund, Forus; Reidar Vik, Hommersak, all of Norway

[73] Assignee: Den Norske Stats Oljeselskap A.S., Stavanger, Norway

[21] Appl. No.: 09/214,363

[22] PCT Filed: Jun. 26, 1997

[86] PCT No.: PCT/NO97/00165

§ 371 Date: May 5, 1999

§ 102(e) Date: May 5, 1999

[87] PCT Pub. No.: WO98/01335

PCT Pub. Date: Jan. 15, 1998

[30] Foreign Application Priority Data

Jul. 1, 1996 [NO] Norway ..... 962776

[51] Int. Cl.[7] ..... F25J 1/00

[52] U.S. Cl. ..... 62/613; 62/614

[58] Field of Search ..... 62/606, 611, 613, 62/614

[56] References Cited

U.S. PATENT DOCUMENTS

| | | | |
|---|---|---|---|
| 3,677,019 | 7/1972 | Olszewski . | |
| 3,894,856 | 7/1975 | Lofredo et al. | 62/614 |
| 4,462,813 | 7/1984 | May et al. | 62/613 |
| 5,025,860 | 6/1991 | Mandrin . | |

FOREIGN PATENT DOCUMENTS

| | | | |
|---|---|---|---|
| 32 00 958 | 7/1983 | Germany . | |
| 32 25 300 | 1/1984 | Germany . | |
| 2039352 | 8/1980 | United Kingdom | 62/613 |
| 2 229 519 | 9/1990 | United Kingdom . | |
| WO 96/17777 | 6/1996 | WIPO . | |
| WO 96/29239 | 9/1996 | WIPO . | |

*Primary Examiner*—William Doerrler

*Attorney, Agent, or Firm*—Sughrue, Mion, Zinn, Macpeak & Seas, PLLC

[57] ABSTRACT

A method of liquefaction/conditioning of a compressed gas/condensate flow extracted from a petroleum deposit, for transport in liquefied form with a transport vessel, especially for such processing of a compressed gas/condensate flow which has been separated from a crude oil extracted from an offshore oil field. The gas/condensate flow is depressurized and cooled in several steps for producing a stabilized liquefied natural gas (LNG) and a stabilized liquefied petroleum gas (LPG), for transport thereof in separate tanks. Disclosed is also a gas expansion plant for execution of the method, and a system for handling and processing of a natural gas from an offshore petroleum field, comprising a production ship to which there is supplied a well stream from an underground source, a field plant installed on the production ship, for processing of the well stream received on the production ship, a vessel for transport of liquefied gas fractions, a high-pressure pipeline arranged for transfer of compressed gas from the field plant to the vessel, and a gas expansion plant according to the invention installed on the transport vessel.

23 Claims, 2 Drawing Sheets

PROCESS, PLANT AND OVERALL SYSTEM FOR HANDLING AND TREATING A HYDROCARBON GAS FROM A PETROLEUM DEPOSIT

FIELD OF THE INVENTION

The present invention relates to a process and a plant for liquefaction/conditioning of a compressed gas/condensate flow extracted from a petroleum deposit, for transport in liquefied form. More specifically, the invention relates to a process and a plan t for such processing of a compressed gas/condensate flow which has been separated from a crude oil extracted from an offshore oil field, for transport thereof in liquefied form with a transport vessel. The invention also relates to an overall system for handling and processing of natural gas from an offshore petroleum field, for transport of the gas in liquefied form with a vessel f or transport of liquefied gas fractions.

BACKGROUND OF THE INVENTION

In the production of crude oil from an offshore oil field there is carried out a separation of the well stream into water, oil and natural gas. The natural gas following the produced crude oil in the well stream, and which is commonly designated "associated gas", will often be desired to be transported from the offshore field to a receiving system on land.

An obvious thought has been to build a plant for the production of liquefied associated gas at a production platform or a production ship which is installed on the field, and which receives the well stream for processing. After separation of the stream into water, oil and gas, the separated gas should be able to be condensed to a liquid condition in which it has a low pressure and a low temperature, and thereafter to be transferred through a pipeline system to a vessel for transport to land in this condition. However, this is not feasible in a practical manner with the technique of today, since cryogenic transfer of liquefied natural gas via conventional "loading arms", or even via more sophisticated transfer systems, is associated with hitherto unsolved problems with freezing, clogging of passages, etc. Such transfer is also associated with danger of an unintended spill of liquefied natural gas onto the sea, which might result in explosion-like evaporation, with a substantial destructing potential.

I order to avoid the cryogenic transfer of condensed gas from the production platform or the production ship to the transport vessel, one could instead think of transferring the natural gas from the production platform or ship to a transport vessel equipped with a complete conventional plant for liquefaction of the natural gas, for production of mainly LNG. However, conventional plants for the production of LNG are very expensive, and it is therefore not economically acceptable to build such plants on individual transport vessels.

Another proposal for solving the problem is described in U.S. Pat. No. 5,025,860. Here is described a system wherein a natural gas from an offshore petroleum deposit is carried to a production platform or production ship where carbon dioxide and water are separated from the natural gas, whereafter the natural gas is compressed and cooled to a compressed gas condition. In this gas condition, under a high pressure, the natural gas is thereafter transported through a pipeline system to an LNG tanker where it is expanded and cooled to form of liquefied natural gas (LNG) which is stored on board in the tanks of the ship. In the expansion and cooling process on board the LNG tanker there is also obtained a non-condensed residual gas which can be carried back to the production platform or ship.

Advantages which are achieved with this natural gas processing system according to U.S. Pat. No. 5,025,860 are stated to be that practically all of the energy required for liquefying the gas on board the LNG-tanker is supplied to the gas on board the production platform or ship. Consequently, the investment cost of the necessary and expensive installation for supply of this energy to the gas will be connected to the production platform or ship, whereas every single one of the LNG-tankers which is to transport the natural gas, only needs a relatively limited production equipment on board, which in addition can be mounted on the upper deck of the ship, on replaceable frame structures suitable for-the purpose.

The natural gas which is of current interest to be conditioned for transport by means of this system according to U.S. Pat. No. 5 025 860, may come from a natural gas source, or it may be a by-product from an oil source (associated gas).

That part of the natural gas processing system according to U.S. Pat. No. 5,025,860 which is installed on board the production platform or ship, and which has for its purpose to purify the natural gas and thereafter to compress and cool the gas for delivery to the LNG-tanker in compressed gas condition, is designed as a traditional plant for this purpose.

That part of the natural gas processing system according to U.S. Pat. No. 5,025,860 which is installed on board the LNG tanker, comprises an expansion plant, wherein the received, cooled high-pressure gas is subjected to an additional cooling and is expanded adiabatically in three stages. A liquefied LNG gas with a pressure of ca. 1 bar is transported as a final product from the expansion plant to storage tanks on board, prepared for transport. Non-condensed gas from the expansion plant is carried through a compression group where it is compressed to a pressure of ca. 30 bar, whereafter it is returned to the production platform or ship through a return line, for use e.g. as a fuel for operation for the compressors for compression and cooling of the natural gas on board the production platform or ship.

SUMMARY OF THE INVENTION

It has now been found that a natural gas processing system of the described type, wherein the natural gas is subjected to an introductory purification and is compressed to a desired high pressure on a production platform or production ship and thereafter is transferred in this compressed condition to a transport vessel to be expanded and liquefied there for transport in liquefied form, can be substantially improved. This is achieved in that the compressed natural gas, which may exist as a gas, as a two-phase mixture of gas and liquid or as a so-called "dense phase", and which is here designated as a gas/condensate flow, is subjected to expansion on board the transport vessel in a specific manner which entails that the entire gas/condensate flow can be stored in stable condition, cooled and at approximately atmospheric pressure, as two distinct products for separate transport with the transport vessel, viz. as LNG and a heavier, liquid petroleum gas LPG (Liquefied Petroleum Gas). This solution gives a good flexibility for the processing of a wide range of gas/condensate qualities.

Thus, with the invention there is provided a method of liquefaction/conditioning of a compressed gas/condensate flow extracted from a petroleum deposit, for transport in liquefied form, especially for such processing of a gas/ condensate flow which has been separated from a crude oil extracted from an offshore oil field, for transport thereof in liquefied form with a vessel for transport of liquefied gas fractions.

With the invention there is moreover provided a plant for execution of the novel method.

BRIEF DESCRIPTION OF THE DRAWINGS

The invention will be further described below in connection with embodiments with reference to the annexed drawings, wherein.

DETAILED DESCRIPTION OF THE PREFERRED EMBODIMENTS

Figure 1:
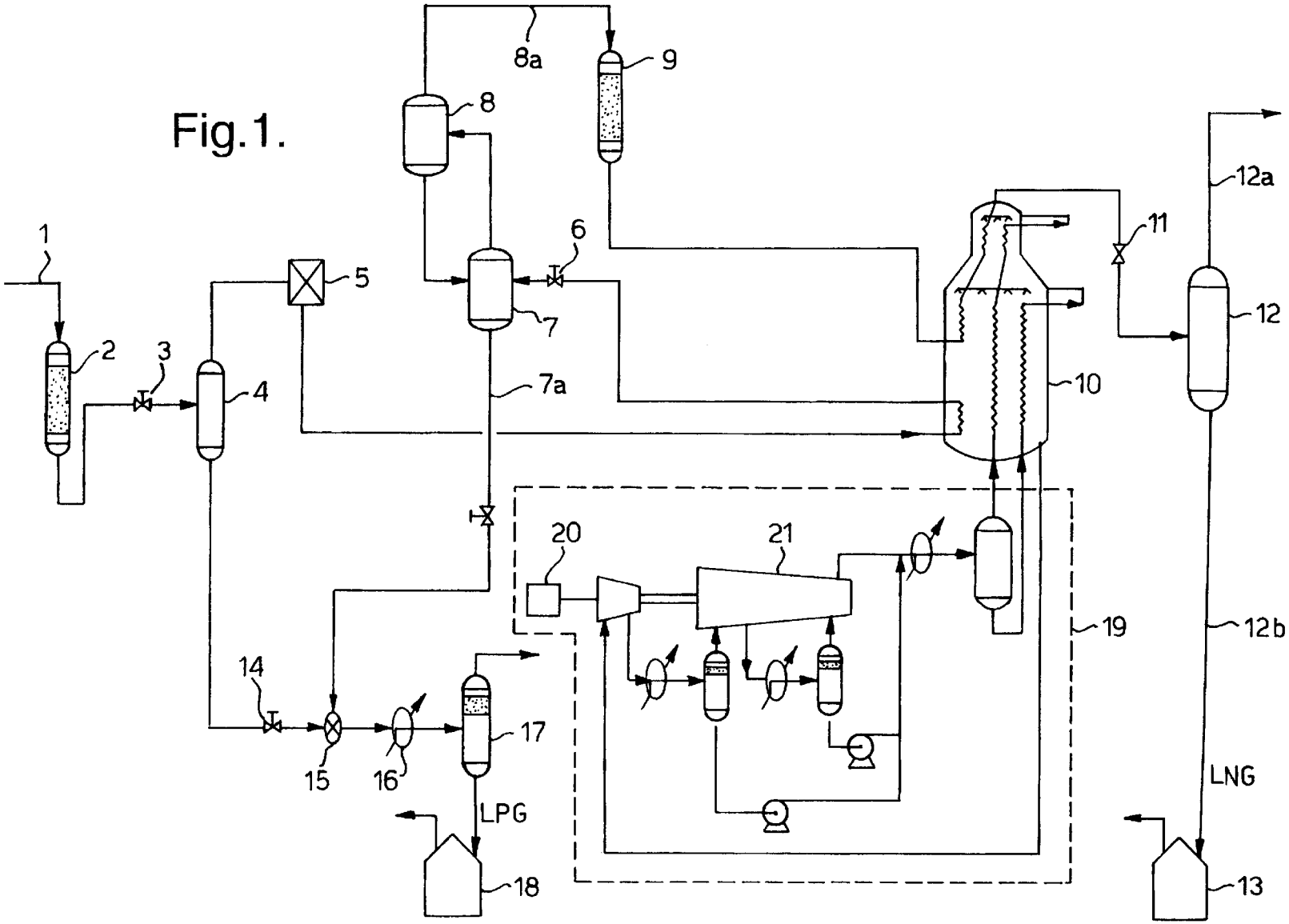
FIG. 1 shows a plant according to the invention for expansion and condensation of an associated gas under a high pressure from an offshore production platform or a production ship.

With reference to FIG. 1 there is firstly described an embodiment of the method according to the invention in a plant according to the invention installed on board a transport vessel.

A flow 1 of gas and condensate, which has been subjected to drying and removal for $CO_2$ in a common known manner, and which, with a pressure of 20–500 bar, especially 100–350 bar, and a temperature in the range from 4° C. to 50° C., is supplied through a pipeline from a production platform or a production ship, is carried via one or more conventional driers 2 to a first pressure relief valve 3, a so-called Joule-Thomson valve. Possibly there may be used several such valves. As an alternative to such an expansion valve, there may be used an isentropic expansion turbine (turbo expander).

After an adiabatic depressurization in the expansion valve 3 to a pressure in the range 40–70 bar and a temperature in the range from +10° C. to −60° C., the flow is introduced to a phase separator 4 wherein it is separated into a gas phase and a liquid phase. The gas phase from the phase separator 4 is carried via a unit 5 for removal of mercury to a pipe coil heat exchanger 10 wherein it is cooled. To remove mercury from this gas phase is necessary for preventing corrosion of the structural material in the heat exchanger.

From the heat exchanger 10 the cooled flow is carried to a second pressure relief valve 6. The pressure after the adiabatic depressurization undertaken in the valve 6 may be ca. 5 bar lower than the pressure after the first pressure relief valve 3. As a result of this depressurization there takes place a condensation of heavier hydrocarbons including aromatics. These components have to be removed because, similar to water and $CO_2$, they will be able to freeze out and clog the process equipment if they are not removed to a sufficiently low level. The depressurized flow from the valve 6 is introduced into a phase separator 7, wherein it is separated into a gas phase and a liquid phase containing said heavier hydrocarbons. The gas phase from the phase separator 7 is carried to a phase separator 8 connected in series with this separator and from which a liquid phase is returned to the phase separator 7. The gas phase 8*a* from the phase separator 8 is carried to a unit 9 wherein $CO_2$ is removed to a level preventing freezing-out with further cooling of the flow, and therefrom to the above-mentioned pipe coil heat exchanger (10), where in the gas phase is condensed and supercooled.

The flow of condensed and supercooled gas from the heat exchanger 10, which has now a pressure close to the atmospheric pressure, thereafter is further pressurized in a third pressure relief valve 11, and the outlet flow therefrom is introduced into a phase separator 12 wherein it arrives with a temperature of from −158° C. to −163° C. After a possible additional let-down of the pressure to a pressure just above the atmospheric pressure, the liquid phase 12*b* from this phase separator is carried to storage in storage tanks 13 at approximately −163° C., as a stabilized liquefied natural gas (LNG). From the phase separator 12 there is also taken out a gas phase 12*a* consisting of a light hydrocarbon gas enriched with nitrogen. This gas may be utilized as a fuel for power-demanding machinery in the plant or in an associated plant (not shown) for example on board the production platform or ship.

The flow 1 of gas and condensate which is supplied to the plant, preferably has such a pressure that the depressurization in the first pressure relief valve 3 can be undertaken to a pressure in the range 60–70 bar.

The liquid phase which is separated in the phase separator 4 after the first depressurization of the gas/condensate flow 1 in the valve 3, is carried to a fourth pressure relief valve 14. The depressurized flow therefrom, which has now an overpressure of 1–2 bar and a temperature of from −30 to −55° C., is mixed in a mixing device 15 with the liquid phase 7*a* from the phase separator 7, and the mixed flow is carried to a heat exchanger 16 wherein, if necessary, there is undertaken an adjustment of the temperature of the flow. From the heat exchanger the flow is carried to a phase separator 17 from which a liquid phase consisting of stabilized liquefied production gas (LPG) is carried to storage tanks 18. This liquefied production gas mainly consists of a mixture of propane and butanes, but it may also contain substantial amounts of methane and components which are heavier than butane.

I the heat exchanger 10 there is used a cryogenic cooling medium from a cooling plant 19 comprising a driving unit 20 and a compressor 21. The cryogenic cooling medium circulates in a closed cooling circuit and for example may be constituted by nitrogen-containing hydrocarbon gas separated in the phase separator 12.

The plant shown in FIG. 1 preferably is driven without any recirculation of non-condensed hydrocarbon flows from the phase separators 12 and 17, and preferably there is used only one driving unit 20. As driving unit 20 it is preferred to use a gas turbine.

For the removal of $CO_2$ in the unit 9 there may be used a traditional molecular sieve equipment, which is very robust against movements (heavy sea). If desired, separated $CO_2$ can be recompressed and returned to the reservoir.

By means of the method and the plant shown in FIG. 1 there is achieved that all the associated gas which is separated in a processing plant on board a production ship or a production platform on an offshore oil field, and which is supplied to the plant according to the invention in compressed form, is able to be handled. The gas flow is condensed into a heavier portion (LPG) and a light portion (LNG), which are stored in stable form individually, cooled down and at approximately atmospheric pressure on board the transport vessel. The method and plant are not energy optimal, but give great savings on the investment side, and they are flexible with respect to enabling the handling of a wide range of gas qualities. In addition, the plant is robust to heavy sea and is in its entirety able to be installed on a single module on board the transport vessel.

The method and plant according to the invention described above may, as appears from the above, advantageously form part of an overall system for processing of a gas/condensate flow from an offshore oil or gas field for transport in liquefied form with a transport vessel.

In offshore production of hydrocarbons (oil and gas) it is known to use production ships which are based on the so-called STP technique (STP=Submerged Turret Production). In this technique there is used a submerged buoy of the type comprising a central, bottom-anchored member communicating with the topical underground source via at least one flexible riser, and which is provided with a swivel unit for the transfer of the fluid under a high pressure to a production plant on the ship. On the central buoy member there is rotatably mounted an outer buoy member which is arranged for introduction and releasable securing in a submerged downwardly open receiving space at the bottom of the ship, so that the ship can turn about the anchored, central buoy member under the influence of wind, waves and water currents. For a further description of this technique there may e.g. be referred to Norwegian laying-open print No. 175 419.

In offshore loading and unloading of hydrocarbons it is further known to use a so-called STL buoy (STL=Submerged Turret Loading) which is based on the same principle as the STP buoy, but which has a simpler swivel device than the STP swivel which normally has several through-going passages or courses. For a further description of this buoy structure there may e.g. be referred to Norwegian laying-open print No. 176 129.

By means of the STP/STL technique there is achieved that one can carry out loading/unloading as well as offshore production of hydrocarbons in nearly all weathers, both connection and disconnection between ship and buoy being able to be carried out in a simple and quick manner, also under very difficult weather conditions with high waves. Further, the buoy can remain connected to the ship in all weathers, a quick disconnection being able to be carried out if a weather limitation should be exceeded.

Because of the substantial practical advantages involved in the STP/STL technique, it would be desirable to be able to use this technique also in connection with the utilization of the natural gas (associated gas) produced together with the oil in offshore oil production.

Thus, with the invention there is also provided an overall system for handling and processing of a natural gas from an offshore petroleum field, for transport of the gas in liquefied form with a transport vessel. That which is characteristic of the system according to invention, is stated in the characterizing part of claim 19. Various embodiments of the system are stated in the dependent claims 20–23.

Figure 2:
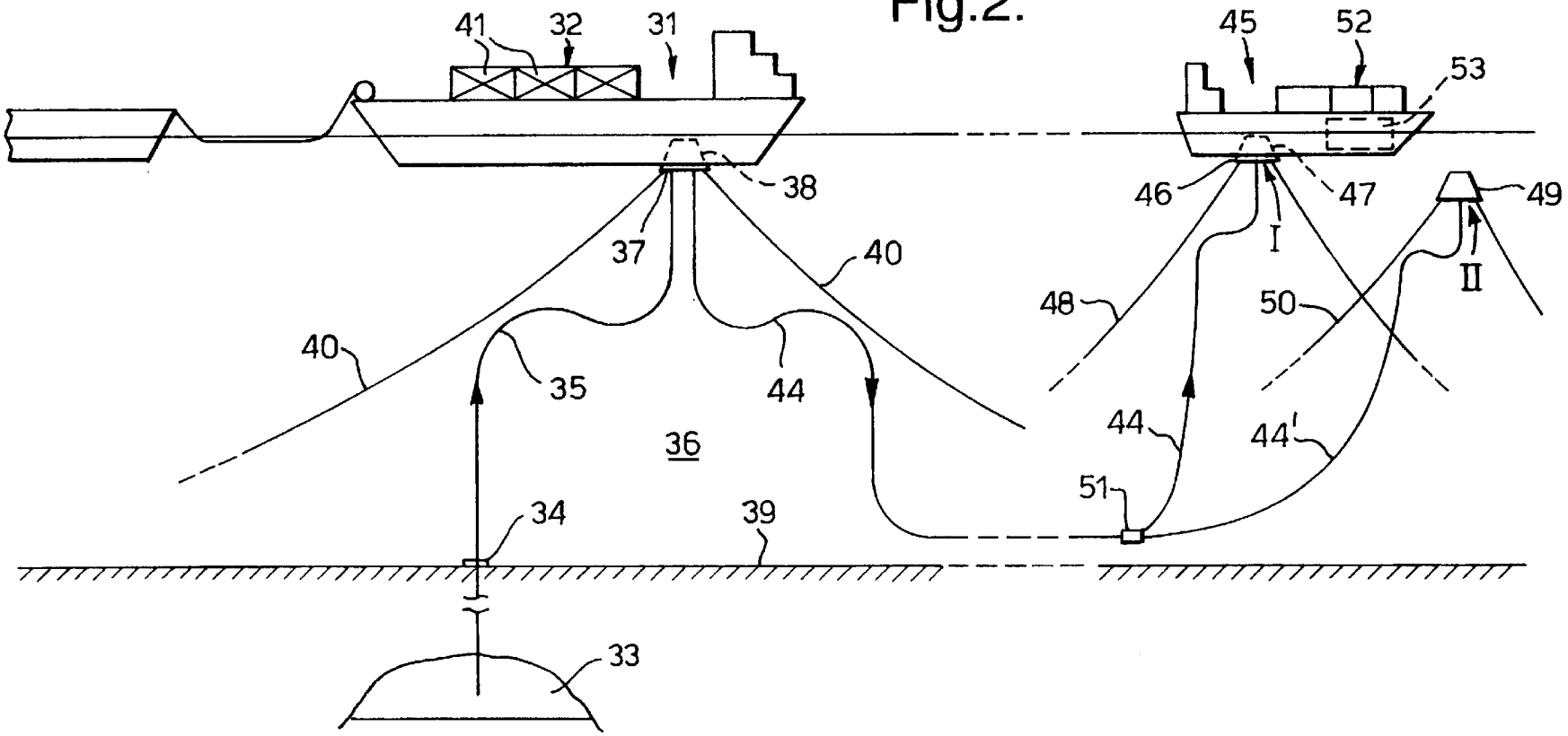
FIG. 2 is a schematic view showing an overall system for processing of an associated gas from an offshore petroleum field, for transport of the gas in liquefied form with a vessel for transport of liquefied gas fractions.

The fundamental construction of the new total system according to the invention for processing of a compressed gas/condensate flow from an offshore oil or gas field for transport in liquefied form with a transport vessel is schematically shown in FIG. 2.

In the illustrated embodiment the system comprises a floating production ship 31 on which there is provided a field plant or installation 32 for processing of a well stream flowing up from an underground source 33. The well stream is supplied via a wellhead 34 and a flexible riser 35 which extends through the body of water 36 and at its upper end is connected to an STP buoy 37 of the above-mentioned type. The buoy is introduced and releasably secured in a submerged downwardly open receiving space 38 at the bottom of the production ship 31. As mentioned above, the buoy comprises a swivel unit forming a flow connection between the riser 35 and a pipe system (not shown) provided on the production ship between the swivel and the field installation 32. The central member of the buoy is anchored to the sea bed 39 by means of a suitable anchoring system comprising a number of anchor lines 40 (only partly shown). For a further description of the buoy and swivel construction reference is made to the aforementioned Norwegian laying-open print 176 129.

The field installation 32 consists of a number of processing units or modules 41 for suitable processing of the supplied well stream from the source 33. After separation of the well stream into water, oil and gas, the gas, which is that part of the well stream which is here of interest, is subjected to drying and removal of $CO_2$ in a usual known manner.

After this treatment of the gas, the gas is compressed to a desired high pressure of at least 150 bar, whereby—as a result of the compression—a heating of the gas to a relatively high temperature takes place. The gas now exists in a condition which is optimal with a view to expansion of the gas to liquid form in an expansion plant according to the invention, which will be substantially more reasonable to build than a conventional LNG plant. However, in certain cases it may be advantageous to cool the compressed gas "maximally" before the gas is supplied to the expansion plant, which is located on board the transport vessel 45.

A flexible pipeline 44 which is arranged for transfer of the compressed gas, extends through the body of water (the sea water) 36 between the production ship 31 and the transport vessel 35. One end of the pipeline at the production ship 31 is permanently connected to the STP buoy 37 and is connected to the field installation 32 via the swivel unit of the buoy and said pipe system on the production ship. The other end of the pipeline 44 is permanently connected to an additional STP buoy 46 which is introduced and releasably secured in a submerged downwardly open receiving space 47 in the transport vessel 45. The buoy is provided with a swivel unit which may be of a similar design as that of the swivel unit in the buoy 37, and its central member is anchored to the sea bed 39 by means of an anchoring system comprising a number of anchor lines 48.

In addition to the buoy 46 (buoy I) there is also provided an additional submerged buoy 49 (buoy II) which is anchored to the sea bed by means of anchor lines 50. The pipeline 44 is also permanently connected to this buoy via a branch pipeline in the form of a flexible riser 44' which is connected to the pipeline 44 at a branch point 51. The purpose of the arrangement of two buoys will be further described later.

The pipeline 44 may extend over a substantial length in the sea, a suitable distance between the production ship 31 and the buoys I and II in practice being 1–2 km. When compressed gas with a high temperature is to be transferred from the field installation 32 through the pipeline, this has been made heat transferring, so that the gas temperature during the transfer is lowered to a desired low temperature close to the sea water temperature, e.g. 4–10° C. On the other hand, when compressed gas at a low temperature is to be transferred, the pipeline has been made heat-insulating, so that the gas temperature is maintained during the transfer.

A plant 52 according to the invention, for expansion and cooling of compressed gas to liquid form, is installed on board the transport vessel 45. The plant is supplied with compressed gas from the pipeline 44, which communicates with the plant via the buoy 46 and a pipe system (not shown) on the transport vessel 45. Liquefied LNG and LPG which are produced in the plant, are stored in tanks 53 on board the transport vessel.

It will often be of interest to transfer residual gas from the expansion plant 52 back to the production ship 31 for recompression/cooling. In such cases the pipeline 44 may also comprise a return line for transfer of such gas from the expansion plant back to the production ship. In some cases it will further be expedient to produce electrical energy as a byproduct from the expansion process in the plant 52. In such cases the pipeline 44 may also comprise a power cable for transfer of electric current from the transport vessel 45 to the production ship 31, as the swivel units of the STP buoys may be constructed for such transfer.

As shown in FIG. 2, the transport vessel 45 is coupled to the loading buoy 46 (buoy I), whereas the additional buoy 49 (buoy II) is submerged, waiting for connection to another transport vessel. In practice one can envisage that the expansion plant 52 can produce e.g. ca. 8 000 tons LNG per day. With a ship size of 80 000 tons the transport vessel 45 then will be able to lie connected to the buoy I for about 10 days before its storage tanks 53 are full. When the tanks are full, the vessel leaves buoy I, and the production continues via buoy II where another transport vessel then is connected. The ready-loaded vessel transports its cargo to a receiving terminal. Based on normal transport distances and said loading time, for example four transport vessels may be connected to the shown arrangement with two buoys I and II, thereby to obtain operation with "direct shuttle loading" (DSL) without any interruption in the production.

Even if direct shuttle loading may be achieved with the shown arrangement, a continuous take-off of gas is not always an absolute presupposition, so that a transport vessel does not need to be continuously coupled to one of the loading buoys. Thus, the transport vessel may leave the field/buoy for at least shorter time periods (some days) without this having negative consequences.

What is claimed is:

1. A method of liquefaction/conditioning of a compressed gas/condensate flow (1) extracted from a petroleum deposit, for transport in liquefied form, especially for such processing of a compressed gas/condensate flow which has been separated from a crude oil extracted from an offshore oil field for transport thereof in liquefied form with a vessel for transport of liquefied gas fractions, wherein (a) the gas/condensate flow (1) is depressurized (3) in a first depressurizing step to a pressure in the range 40–70 bar and a temperature in the range from +10° C. to −60° C. and thereafter is separated into a gas phase and a liquid phase in a phase separator (4), (b) the gas phase from the phase separator (4) is cooled in a heat exchanger (10), (c) the cooled gas phase from the heat exchanger (10) is depressurized adiabatically (6) in a second depressurizing step, with subsequent separation into a gas phase **(8*a*) and a liquid phase (7*a*) in one or more serially connected phase separators (7, 8), (d) the gas phase (8*a*) from the second depressurizing step is carried to the heat exchanger (10) where it is condensed and supercooled, (e) the liquid phase from the heat exchanger (10) is depressurized (11) in a third depressurizing step and carried at a temperature of from −158 to −163° C. to a final phase separator (12) wherein a light nitrogen-enriched hydrocarbon gas (12*a*) is separated from a liquid phase (12*b*), the pressure of the extracted liquid phase (12*b*) is let down, and this liquid phase, consisting of a stabilized liquefied natural gas (LNG), is carried to be stored in storage tanks (13) at approximately −163° C. and a pressure at or just above the atmospheric pressure, and (f) the liquid phases from the phase separators (4 resp. 7) associated with the first and second depressurizing steps (3 resp. 6) are converted by depressurization, temperature control (16), and final phase separation (17)** to a liquid phase consisting of a stabilized liquefied petroleum gas (LPG) and a gas phase.

2. A method according to claim 1, wherein the depressurization in each of the four depressurizing steps is carried out adiabatically, through one or more Joule-Thomson valves (resp. 3, 6, 11 and 14).

3. A method according to claim 1 or 2, wherein the depressurization (3) in the first depressurizing step (step a) is carried out at a pressure in the range 60–70 bar.

4. A method according to claim 1, wherein, as a heat exchanger (10), there is used a pipe coil heat exchanger.

5. A method according to claim 1, wherein, in the second depressurizing step (step c), there are used two series-connected phase separators (7, 8).

6. A method according to claim 1, wherein the depressurization (6) in the second depressurizing step (step c) is carried out at a pressure which is approximately 5 bar lower than the pressure after the first depressurizing step (step a).

7. A method according to claim 1, wherein the following two steps (f) and (g):

(f) the liquid phase from the phase separator (4) of the first depressurizing step is depressurized (14) in a fourth depressurizing step to an overpressure of 1–2 bar and a temperature from −30 to −55° C. and thereafter is mixed in a mixing device (15) with the liquid phase **(7*a*) from the second depressurizing step, and (g) the mixed liquid phase from the mixing device (15), after an adjustment of the temperature in a heat exchanger (16), is separated in a final phase separator (17) from which a liquid phase consisting of stabilized liquefied petroleum gas (LPG) is carried to storage tanks (18)**.

8. A method according to claim 1, wherein, as a cooling medium in the heat exchanger (10), there is used a cryogenic cooling medium which circulates in a closed cooling circuit and is cooled and condensed in a cooling plant (19) comprising a driving unit (20) and a compressor (21).

9. A method according to claim 8, wherein the driving unit (20) is a gas turbine.

10. A method according to claim 1, wherein, as a cryogenic cooling medium in the heat exchanger (10), there is used a nitrogen-containing, light hydrocarbon gas separated in the further phase separator (12).

11. A method according to claim 1, wherein that nitrogen-containing, light hydrocarbon gas separated in the further phase separator (12) and/or gas separated in a final phase separator (17), is used as a fuel for power-demanding machinery in the plant or an associated plant.

12. A method according to claim 1, wherein it is carried out without recirculation of non-condensed hydrocarbon flows and by the use of only one driving unit (20).

13. A plant for liquefaction/conditioning of a compressed gas/condensate flow (1) extracted from a petroleum deposit, for transport in liquefied form, especially for such processing of a compressed gas/condensate flow which has been separated from a crude oil extracted from an offshore oil field for transport thereof in liquefied form with a vessel for transport of liquefied gas fractions, comprising:

(a) a first pressure relief device (3) for depressurizing the gas/condensate flow (1) to a pressure in the range 40–70 bar and a temperature in the range from +10° C. to −60° C., and a first phase separator (4) for separation of the flow from the pressure relief device (3) into a gas phase and a liquid phase, (b) a second pressure relief device (6) for adiabatic depressurization of the gas phase from the first phase separator (4) after previous cooling of this gas phase, and one or more series-connected phase separators (7, 8) for separation of the flow from the second pressure relief device (6) into a gas phase **(8*a*) and a liquid phase (7*a*), (c) a heat exchanger (10) for cooling of the gas phase from the first phase separator (4) and for condensing and supercooling the gas phase (8*a*) from the series-connected phase separator(s) (7, 8), (d) a third pressure relief device (11) for adiabatic depressurization of the gas phase condensed and supercooled in the heat exchanger (10) and coming from the series-connected phase separator(s) (7, 8), and a further phase separator (12) for separation of the flow from the pressure relief device (11) into a gas phase (12*a*) and a liquid phase (12*b*) consisting of stabilized liquefied natural gas (LNG), (e) storage tanks (13) for reception and storage of the liquid phase (12*b*) consisting of stabilized liquefied natural gas (LNG), (f) a fourth pressure relief device (14) for adiabatic depressurization of the liquid phase from the phase separator (4) to an overpressure in the range 1–2 bar and a temperature in the range of −30° C. to −55° C., (g) devices for depressurizing (14), temperature control (16) and phase separation (17) of the liquid phases from the liquid phase from the phase separators (4, 7) associated with first and fourth pressure relief devices (3, 6) for achieving a stabilized liquefied petroleum gas (LPG) and a gas phase, (h) storage tanks (18) for reception and storage of the liquid phase consisting of the stabilized liquefied petroleum gas (LPG), and (i) a cooling plant (19) for delivery of a cooling medium to the heat exchanger (10) in a closed cooling circuit, which cooling plant comprises a driving unit (20) and a compressor (21)**.

14. A plant according to claim 13, wherein each of the pressure relief devices (3, 6, 11, 14) is constituted by one or more Joule-Thomson valves.

15. A plant according to claim 13, wherein the heat exchanger (10) is a pipe coil heat exchanger.

16. A plant according to claim 13, further comprising two phase separators (7, 8) for the second pressure-relief step.

17. A plant according to claim 13, further comprising:

a mixing device (15) for mixing of the depressurized flow from the fourth pressure-relief device (14) with the liquid phase **(7*a*) from the series-connected phase separator(s) (7, 8), and a further heat exchanger (16) for adjusting the temperature of the mixture flow from the mixing device (15), and a phase separator (17) for separation of the flow from the further heat exchanger (16)** into a gas phase and a liquid phase consisting of stabilized liquefied petroleum gas (LPG).

18. A plant according to claim 13, wherein the driving unit (20) of the cooling plant (19) is a gas turbine.

19. A system for handling and processing of a natural gas from an offshore petroleum field, for transport of the gas in liquefied form with a transport vessel, comprising:

(A) a production ship (31) to which there is supplied a well stream from an underground source (33), (B) a field installation (32) installed on the production ship (31), for processing of the well stream received on the production ship, including separation of the well stream into water, oil, and gas, which field installation comprises a sub-installation for purifying gas separated from the well stream and for compressing and cooling this gas to a desired high pressure and a desired temperature, (C) a vessel (45) for transport of liquefied gas fractions, (D) a high-pressure pipeline (44) which is arranged for transfer of the compressed gas from the field installation (32) to the vessel (45), and which extends through a surrounding body of water (36), which pipeline (44) at the end which is connected to the field installation (32), is permanently coupled to a loading buoy (37) arranged for introduction and releasable securing in a submerged downwardly open receiving space (38) at the bottom of the production ship (31), and which is provided with a swivel unit for transfer of gas under a high pressure, the swivel unit also being coupled to a transfer line (35) communicating with the underground source (33), and at the end which is remote from the field installation (32) is permanently coupled to at least one loading buoy (46) arranged for introduction and releasable securing in a submerged downwardly open receiving space (47) at the bottom of the vessel (45), and which is provided with a swivel unit for transfer of gas under a high pressure, and (E) a gas expansion plant (52) according to claim 13 installed on the transport vessel (45).

20. A system according to claim 19, wherein the pipeline (44) is coupled to two loading buoys (46, 49) via respective flexible risers.

21. A system according to claim 19, wherein the loading buoys (37, 46, 49) are STP buoys.

22. A system according to claim 19, wherein the pipeline (44) also comprises a return line for transfer of residual gas from the expansion plant (52) back to the field plant (32).

23. A system according to claim 19, wherein the pipeline (44) also comprises a power line for transfer of electric current to the field plant (32) from a power-producing device driven by surplus energy generated by operation of the expansion plant (52).

* * * * *